US007940428B2

(12) United States Patent
Shimizu

(10) Patent No.: US 7,940,428 B2
(45) Date of Patent: May 10, 2011

(54) IMAGE GENERATING APPARATUS

(75) Inventor: Daisuke Shimizu, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 1155 days.

(21) Appl. No.: 11/652,038

(22) Filed: Jan. 11, 2007

(65) Prior Publication Data

US 2007/0170642 A1 Jul. 26, 2007

(30) Foreign Application Priority Data

Jan. 23, 2006 (JP) ..... 2006-013270

(51) Int. Cl.

| | |
|---|---|
| ***B41C 1/02*** | (2006.01) |
| ***G06K 15/22*** | (2006.01) |
| ***B65H 7/02*** | (2006.01) |
| ***B65H 1/08*** | (2006.01) |

(52) U.S. Cl. ..... 358/3.32; 358/1.3; 358/498; 271/31; 271/147

(58) Field of Classification Search ..... 358/498, 358/296, 497, 496, 488, 1.5, 1.3, 1.12, 1.18, 358/3.32; 271/31, 38, 130, 147, 148, 149, 271/160, 153

See application file for complete search history.

(56) References Cited

U.S. PATENT DOCUMENTS

| | | | | |
|---|---|---|---|---|
| 4,295,731 | A * | 10/1981 | Sasaki et al. | 399/118 |
| 5,199,694 | A * | 4/1993 | Iseda | 271/9.05 |
| 5,347,349 | A * | 9/1994 | Sato et al. | 399/392 |
| 5,383,654 | A * | 1/1995 | Iseda | 271/9.05 |
| 5,397,191 | A * | 3/1995 | Murakami et al. | 400/636.1 |
| 5,482,390 | A * | 1/1996 | Murakami et al. | 400/636.2 |
| 5,494,364 | A * | 2/1996 | Murakami et al. | 400/599.1 |
| 6,753,894 | B2 * | 6/2004 | Yoshida | 347/217 |
| 2002/0180859 | A1 * | 12/2002 | Yoshida | 347/171 |

FOREIGN PATENT DOCUMENTS

| | | | |
|---|---|---|---|
| JP | 7-300244 | A | 11/1995 |
| JP | 8-175697 | A | 7/1996 |
| JP | 9-194050 | A | 7/1997 |

* cited by examiner

*Primary Examiner* — Madeleine A Nguyen
(74) *Attorney, Agent, or Firm* — Crowell & Moring LLP

(57) ABSTRACT

A push-up member of this image generating apparatus includes a first push-up member integrally having a first assembly engaging portion provided between a first spring clip portion and a first engaging portion and a second push-up member integrally having a second assembly engaging portion rotatably engaging with the first assembly engaging portion, and the first engaging portion and the second engaging portion are engaged with each other in assembling by engaging the first assembly engaging portion and the second assembly engaging portion with each other while mounting first and second ends of a spring member on the first push-up member and the second push-up member respectively and rotating the second push-up member about the engaging position between the first assembly engaging portion and the second assembly engaging portion against urging force of the spring member.

15 Claims, 12 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a push-up member for pushing up a paper and bringing the same into contact with a paper feed roller.

2. Description of the Background Art

In general, a feeder comprising a push-up member for pressing a paper against a paper feed roller carrying the same in a paper feed direction is known as that employed for an image generating apparatus such as a thermal transfer printer, as disclosed in Japanese Patent Laying-Open No. 8-175697 (1996), for example.

The feeder disclosed in the aforementioned Japanese Patent Laying-Open No. 8-175697 comprises a tray member loaded with papers, a paper position detecting mechanism detecting a paper feeding position (height), a cam (push-up member) for pushing up the tray member in response to the paper height, pivotal means (rotating shaft) on which the push-up member is rotatably mounted, a screw for rotationally driving the push-up member, a motor for rotating the screw, a nut for transmitting the rotation of the screw to the push-up member and a feed roll (paper feed roller). The feeder electrically detects the uppermost paper reaching the paper feeding position with the paper position detecting mechanism and electrically controls the motor, serving as a drive source for the cam (push-up member), to stop on the basis of a detection signal thereby changing the quantity of rotation of the cam (push-up member) so that the uppermost paper is on the paper feeding position in response to the number of the papers. In the feeder disclosed in the aforementioned Japanese Patent Laying-Open No. 8-175697, the screw driven by the motor rotates the push-up member (cam) about the pivotal means (rotating shaft) through the nut. This push-up member (cam) pushes up the tray member loaded with the papers from below, thereby pressing each paper against the feed roll (paper feed roller) and feeding the papers.

However, the feeder disclosed in the aforementioned Japanese Patent Laying-Open No. 8-175697 disadvantageously requires the electrical control, in order to rotate the cam (push-up member) for locating the uppermost paper on the paper feeding position in response to the number of the papers.

In order to solve this problem, there is proposed a feeder requiring no electrical control for changing the quantity of rotation of a push-up member in response to the number of papers, as disclosed in each of Japanese Patent Laying-Open Nos. 7-300244 (1995) and 9-194050 (1997).

The feeder proposed in the aforementioned Japanese Patent Laying-Open No. 7-300244 comprises a pressure plate (first push-up member) pushing up a hopper plate loaded with papers, a shaft on which the pressure plate is rotatably mounted, a rotatable pressure cam (second push-up member), a spring (spring member) having first and second ends mounted on the pressure cam and the pressure plate respectively and a paper feed roller. This feeder according to Japanese Patent Laying-Open No. 7-300244 rotates the pressure plate (first push-up member) about the shaft with urging force of the spring pulled through rotation of the pressure cam (second push-up member). Thus, the pressure plate (first push-up member) pushes up the hopper plate loaded with the papers from below and presses each paper against the paper feed roller, thereby feeding the papers. The feeder according to the aforementioned Japanese Patent Laying-Open No. 7-300244 automatically varies the quantity of rotation of the pressure plate with the number of the papers through expansion/contraction of the spring, to require no electrical control for changing the quantity of rotation of the pressure plate.

The feeder proposed in the aforementioned Japanese Patent Laying-Open No. 9-194050 comprises a pressure arm for pushing up a bottom plate loaded with papers, a rotatable support shaft supporting the pressure arm, a first lever rotatably mounted on the support shaft, a rotatable second lever, a spring (spring member) having first and second ends mounted on the first and second levers respectively and a paper feed roller. In this feeder disclosed in Japanese Patent Laying-Open No. 9-194050, it is conceivable that the pressure arm and the first lever constitute a first push-up member while the second lever constitutes a second push-up member. The second lever is so rotated as to rotate the first lever through the spring, thereby rotating the pressure arm about the support shaft. The rotated pressure arm pushes the bottom plate loaded with the papers from below and presses each paper against the paper feed roller, thereby feeding the papers. The feeder according to the aforementioned Japanese Patent Laying-Open No. 9-194050 automatically varies the quantity of rotation of the pressure arm with the number of the papers through expansion/contraction of the spring, to require no electrical control for changing the quantity of rotation of the pressure arm.

However, the feeder disclosed in the aforementioned Japanese Patent Laying-Open No. 7-300244 is provided with different rotating shafts for the pressure plate (first push-up member) and the pressure cam (second push-up member) respectively in the structure connecting the pressure plate (first push-up member) and the pressure cam (second push-up member) with each other through the spring member, and hence the number of components is disadvantageously increased.

The feeder disclosed in the aforementioned Japanese Patent Laying-Open No. 9-194050 is provided with the support shaft (rotating shaft) for the first lever and a rotating shaft for the second lever (second push-up member) respectively for individually rotating the first and second levers in the structure connecting the first lever constituting the first pushup member along with the pressure arm and the second lever constituting the second pushup member, and hence the number of components is disadvantageously increased. Further, the first push-up member is constituted of two members, i.e., the pressure arm and the first lever, to also increase the number of components.

SUMMARY OF THE INVENTION

The present invention has been proposed in order to solve the aforementioned problems, and an object thereof is to provide an image generating apparatus comprising a push-up member capable of pushing up each paper while suppressing increase of the number of components with no requirement for electrical control for varying the quantity of rotation of the push-up member with the number of papers.

In order to attain the aforementioned object, an image generating apparatus according to a first aspect of the present invention comprises a paper feed roller carrying a paper in a paper feed direction and a push-up member for pushing up the paper and bringing the same into contact with the paper feed roller, while the push-up member includes a first push-up member, integrally having a first engaging portion employed after assembling, a first spring clip portion and a first assembly engaging portion provided between the first spring clip portion and the first engaging portion to be employed in assembling, arranged on the side of the paper, a second push-up member integrally having a second engaging portion rotatably engaging with the first engaging portion of the first push-up member after assembling, a second assembly engaging portion rotatably engaging with the first assembly engaging portion in assembling and a second spring clip portion and a spring member mounted on the first spring clip portion of the first push-up member and the second spring clip portion of the second push-up member, so that the first engaging portion and the second engaging portion are engaged with each other in assembling by engaging the first assembly engaging portion and the second assembly engaging portion with each other while mounting first and second ends of the spring member on the first push-up member and the second push-up member respectively and at least rotating at least either the first push-up member or the second push-up member about the engaging position between the first assembly engaging portion and the second assembly engaging portion against urging force of the spring member.

In the image generating apparatus according to the first aspect, as hereinabove described, the first engaging portion of the first push-up member rotatably engages with the second engaging portion of the second push-up member and the first and second ends of the spring member are mounted on the first and second spring clip portions of the first and second push-up members respectively, whereby the first push-up member can be movably mounted on the second push-up member in the structure connecting the first and second push-up members with each other through the spring member. Thus, the first push-up member can be rotated about the second engaging portion of the second push-up member with no additional component such as a rotating shaft in the structure connecting the first and second push-up members with each other through the spring member, whereby the number of components can be inhibited from increase as compared with a case of separately providing a rotating shaft or the like for rotating the first push-up member. When the number of papers varies in the structure connecting the first and second push-up members with each other through the spring member, each paper can be pressed against the paper feed roller with a proper pressure through expansion/contraction of the spring member in response to the number of the papers, to require no electrical control for changing the quantity of rotation of the push-up member. Further, the push-up member can be easily assembled by engaging the first and second assembly engaging portions with each other while mounting the first and second ends of the spring member on the first and second push-up members respectively and at least rotating at least either the first push-up member or the second push-up member about the engaging position between the first and second assembly engaging portions against the urging force of the spring member thereby engaging the first and second engaging portions with each other. Thus, the push-up member can be assembled with no jig or the like also when the spring member has such a large spring constant that the same cannot be expanded without a jig or the like. Also when the number of papers varies, in addition, the image generating apparatus can press the paper against the paper feed roller with a proper pressure through the spring member expanded/contracted in response to the number of the papers.

In the aforementioned image generating apparatus according to the first aspect, the first assembly engaging portion of the first push-up member and the second assembly engaging portion of the second push-up member are provided on positions to be rotated in engagement with each other thereby engaging the first engaging portion and the second engaging portion with each other. According to this structure, the first and second assembly engaging portions of the first and second push-up members align with each other in the paper feed direction. Thus, the first and second engaging portions can be engaged with each other by rotating only either the first push-up member or the second push-up member about the engaging position between the first and second assembly engaging portions of the first and second push-up members, whereby the push-up member can be easily assembled.

In the aforementioned image generating apparatus according to the first aspect, the first assembly engaging portion of the first push-up member preferably includes a recess portion, and the second assembly engaging portion of the second push-up member preferably includes a projecting portion rotatably engaging with the recess portion in assembling. According to this structure, the first and second assembly engaging portions can be simply shaped and easily engaged with each other.

In this case, the width of the recess portion of the first push-up member in a direction perpendicular to the paper feed direction is preferably so sized that the recess portion is engageable with the projecting portion of the second push-up member and the projecting portion of the second push-up member is substantially hardly movable with respect to the recess portion of the first push-up member in the direction perpendicular to the paper feed direction in this engaging state. According to this structure, the recess portion of the first push-up member and the projecting portion of the second push-up member can be inhibited from deviation in the direction perpendicular to the paper feed direction when at least either the first push-up member or the second push-up member is rotated about the engaging position between the recess portion of the first push-up member and the projecting portion of the second push-up member. Thus, the push-up member can be easily assembled.

In the aforementioned image generating apparatus according to the first aspect, the first assembly engaging portion of the first push-up member preferably includes a projecting portion engaging with the second assembly engaging portion in assembling, and the second push-up member preferably includes a relief portion provided on a position corresponding to the projecting portion of the first push-up member after assembling for relieving the projecting portion after assembling. According to this structure, the first and second engaging portions can be engaged with each other in assembling by engaging the projecting portion constituting the first assembly engaging portion and the second assembly engaging portion with each other while mounting the first and second ends of the spring member on the first and second push-up members respectively, rotating at least either the first push-up member or the second push-up member about the engaging position between the projecting portion and the second assembly engaging portion against the urging force of the spring member and thereafter sliding the second push-up member in the direction perpendicular to the paper feed direction thereby relieving the projecting portion constituting the first assembly engaging portion to the relief portion. Further, the projecting portion of the first push-up member can be located on the position of the relief portion of the second push-up member after assembling the push-up member, to be inhibited from interfering with the second push-up member. Thus, the push-up member can be assembled to correctly operate.

In the aforementioned structure having the first and second assembly engaging portions of the first and second push-up members including the recess portion and the projecting portion respectively, the recess portion and the projecting portion preferably include a first engaging section and a second engaging section for rotatably engaging with each other respectively, and the first engaging section of the projecting portion and the second engaging section of the recess portion are preferably so formed as to extend in a first direction perpendicular to the rotational direction of at least either the first push-up member or the second push-up member upon engagement between the first engaging portion and the second engaging portion. According to this structure, the first engaging section of the recess portion and the second engaging section of the projecting portion can be linearly brought into contact with and engaged with each other along the first direction perpendicular to the aforementioned rotational direction. Thus, the area of the engaging portion between the recess portion and the projecting portion is enlarged as compared with a case of engaging the recess portion and the projecting portion with each other in a dotted manner, whereby the recess portion and the projecting portion can be inhibited from disengagement. Further, at least either the first push-up member or the second push-up member can be rotated about the linear engaging portion between the first and second engaging sections linearly extending in the direction perpendicular to the aforementioned rotational direction, whereby the rotational direction of at least either the first push-up member or the second push-up member can be inhibited from deviation. Thus, at least either the first push-up member or the second push-up member can be easily rotated in the aforementioned rotational direction.

In the aforementioned structure having the recess portion and the projecting portion including the first and second engaging sections for rotatably engaging with each other respectively, the length of the second engaging section of the projecting portion in the first direction is preferably rendered larger than the protruding length of the projecting portion. According to this structure, the mechanical strength of the projecting portion can be increased with respect to a load applied to the projecting portion when at least either the first push-up member or the second push-up member is rotated. Thus, the projecting portion can be inhibited from deformation or breakage.

In the aforementioned structure having the recess portion and the projecting portion including the first and second engaging sections for rotatably engaging with each other respectively, the recess portion and the projecting portion may be rectangularly formed in plan view.

In the aforementioned image generating apparatus according to the first aspect, the second engaging portion preferably includes a receiving hole having a size capable of receiving the first engaging portion, and the second engaging portion is preferably so formed that the first engaging portion and the second engaging portion are rotatably engaged with each other by engaging the first assembly engaging portion and the second assembly engaging portion with each other and rotating at least the first push-up member or the second push-up member about the engaging position between the first assembly engaging portion and the second assembly engaging portion against urging force of the spring member thereby inserting the first engaging portion into the receiving hole of the second engaging portion. According to this structure, the first and second engaging portions can be rotatably engaged with each other by simply rotating at least either the first push-up member or the second push-up member about the engaging position between the first and second assembly engaging portions thereby inserting the first engaging portion into the receiving hole of the second engaging portion.

In the aforementioned image generating apparatus according to the first aspect, the first assembly engaging portion is preferably provided between the first spring clip portion and the first engaging portion, and the second assembly engaging portion is preferably provided closer to the first push-up member than the second engaging portion. According to this structure, the first and second engaging portions can be easily approached to each other by rotating at least either the first push-up member or the second push-up member while engaging the first and second assembly engaging portions with each other.

An image generating apparatus according to a second aspect of the present invention comprises a paper feed roller carrying a paper in a paper feed direction and a push-up member for pushing up the paper and bringing the same into contact with the paper feed roller, while the push-up member includes a first push-up member, integrally having a first engaging portion employed after assembling, a first spring clip portion and a first assembly engaging portion formed by a recess portion provided between the first spring clip portion and the first engaging portion to be employed in assembling, arranged on the side of the paper, a second push-up member integrally having a second engaging portion rotatably engaging with the first engaging portion of the first push-up member after assembling, a second assembly engaging portion formed by a projecting portion rotatably engaging with the recess portion forming the first assembly engaging portion in assembling and a second spring clip portion and a spring member mounted on the first spring clip portion of the first push-up member and the second spring clip portion of the second push-up member, the recess portion of the first push-up member and the projecting portion of the second push-up member are provided on positions to be rotated in engagement with each other thereby engaging the first engaging portion and the second engaging portion with each other, and the width of the recess portion forming the first assembly engaging portion of the first push-up member in a direction perpendicular to the paper feed direction is so sized that the recess portion is engageable with the projecting portion forming the second assembly engaging portion of the second push-up member and the projecting portion of the second push-up member is substantially hardly movable with respect to the recess portion of the first push-up member in the direction perpendicular to the paper feed direction in this engaging state, so that the first engaging portion and the second engaging portion are engaged with each other in assembling by engaging the recess portion and the projecting portion with each other while mounting first and second ends of the spring member on the first push-up member and the second push-up member respectively and rotating at least either the first push-up member or the second push-up member about the engaging position between the recess portion and the projecting portion against urging force of the spring member.

In the image generating apparatus according to the second aspect, as hereinabove described, the first engaging portion of the first push-up member rotatably engages with the second engaging portion of the second push-up member and the first and second ends of the spring member are mounted on the first and second spring clip portions of the first and second push-up members respectively, whereby the first push-up member can be rotatably mounted on the second push-up member in the structure connecting the first and second push-up members with each other through the spring member. Thus, the first push-up member can be rotated about the second engaging portion of the second push-up member with no additional component such as a rotating shaft in the structure connecting the first and second push-up members with each other through the spring member, whereby the number of components can be inhibited from increase as compared with a case of separately providing a rotating shaft or the like for rotating the first push-up member. When the number of papers varies in the structure connecting the first and second push-up members with each other through the spring member, each paper can be pressed against the paper feed roller with a proper pressure through expansion/contraction of the spring member in response to the number of the papers, to require no electrical control for changing the quantity of rotation of the push-up member. Further, the push-up member can be easily assembled by engaging the first and second assembly engaging portions with each other while mounting the first and second ends of the spring member on the first and second push-up members respectively and rotating at least either the first push-up member or the second push-up member about the engaging position between the first and second assembly engaging portions against the urging force of the spring member thereby engaging the first and second engaging portions with each other. Thus, the push-up member can be assembled with no jig or the like also when the spring member has such a large spring constant that the same cannot be expanded without a jig or the like.

In the image generating apparatus according to the second aspect, further, the first and second assembly engaging portions of the first and second push-up members are provided on the positions to be rotated in engagement with each other thereby engaging the first engaging portion and the second engaging portion with each other so that the first and second engaging portions are engaged with each other by simply rotating at least either the first push-up member or the second push-up member about the engaging position between the first and second assembly engaging portions of the first and second push-up members, whereby the push-up member can be easily assembled. In addition, the first assembly engaging portion includes the recess portion and the second assembly engaging portion includes the projecting portion, whereby the first and second assembly engaging portions can be simply shaped and easily engaged with each other. Further, the width of the recess portion of the first push-up member in the direction perpendicular to the paper feed direction is so sized that the recess portion is engageable with the projecting portion of the second push-up member and the projecting portion of the second push-up member is substantially hardly movable with respect to the recess portion of the first push-up member in the direction perpendicular to the paper feed direction in this engaging state, whereby the recess portion of the first push-up member and the projecting portion of the second push-up member can be inhibited from deviation in the direction perpendicular to the paper feed direction when at least either the first push-up member or the second push-up member is rotated about the engaging position between the recess portion of the first push-up member and the projecting portion of the second push-up member. Thus, the push-up member can be easily assembled.

In the aforementioned image generating apparatus according to the second aspect, the recess portion and the projecting portion preferably include a first engaging section and a second engaging section for rotatably engaging with each other respectively, and the first engaging section of the projecting portion and the second engaging section of the recess portion are preferably so formed as to extend in a first direction perpendicular to the rotational direction of at least either the first push-up member or the second push-up member upon engagement between the first engaging portion and the second engaging portion. According to this structure, the first engaging section of the recess portion and the second engaging section of the projecting portion can be linearly brought into contact with and engaged with each other along the first direction perpendicular to the aforementioned rotational direction. Thus, the area of the engaging portion between the recess portion and the projecting portion is enlarged as compared with a case of engaging the recess portion and the projecting portion with each other in a dotted manner, whereby the recess portion and the projecting portion can be inhibited from disengagement. Further, at least either the first push-up member or the second push-up member can be rotated about the linear engaging portion between the first and second engaging sections linearly extending in the direction perpendicular to the aforementioned rotational direction, whereby the rotational direction of at least either the first push-up member or the second push-up member can be inhibited from deviation. Thus, at least either the first push-up member or the second push-up member can be easily rotated in the aforementioned rotational direction.

In the aforementioned image generating apparatus according to the second aspect, the length of the second engaging section of the projecting portion in the first direction is preferably rendered larger than the protruding length of the projecting portion. According to this structure, the mechanical strength of the projecting portion can be increased with respect to a load applied to the projecting portion when at least either the first push-up member or the second push-up member is rotated. Thus, the projecting portion can be inhibited from deformation or breakage.

In the aforementioned image generating apparatus according to the second aspect, the recess portion and the projecting portion may be rectangularly formed in plan view.

In the aforementioned image generating apparatus according to the second aspect, the second engaging portion preferably includes a receiving hole having a size capable of receiving the first engaging portion, and the second engaging portion is preferably so formed that the first engaging portion and the second engaging portion are rotatably engaged with each other by engaging the first assembly engaging portion and the second assembly engaging portion with each other and rotating at least the first push-up member or the second push-up member about the engaging position between the first assembly engaging portion and the second assembly engaging portion against urging force of the spring member thereby inserting the first engaging portion into the receiving hole of the second engaging portion. According to this structure, the first and second engaging portions can be rotatably engaged with each other by simply rotating at least either the first push-up member or the second push-up member about the engaging position between the first and second assembly engaging portions thereby inserting the first engaging portion into the receiving hole of the second engaging portion.

In the aforementioned image generating apparatus according to the second aspect, the first assembly engaging portion is preferably provided between the first spring clip portion and the first engaging portion, and the second assembly engaging portion is preferably provided closer to the first push-up member than the second engaging portion. According to this structure, the first and second engaging portions can be easily approached to each other by rotating at least either the first push-up member or the second push-up member while engaging the first and second assembly engaging portions with each other.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

The structure of a thermal transfer printer according to a first embodiment of the present invention is described with reference to FIGS. 1 to 12. According to the first embodiment, the present invention is applied to the thermal transfer printer, which is an exemplary image generating apparatus.

Figure 1:
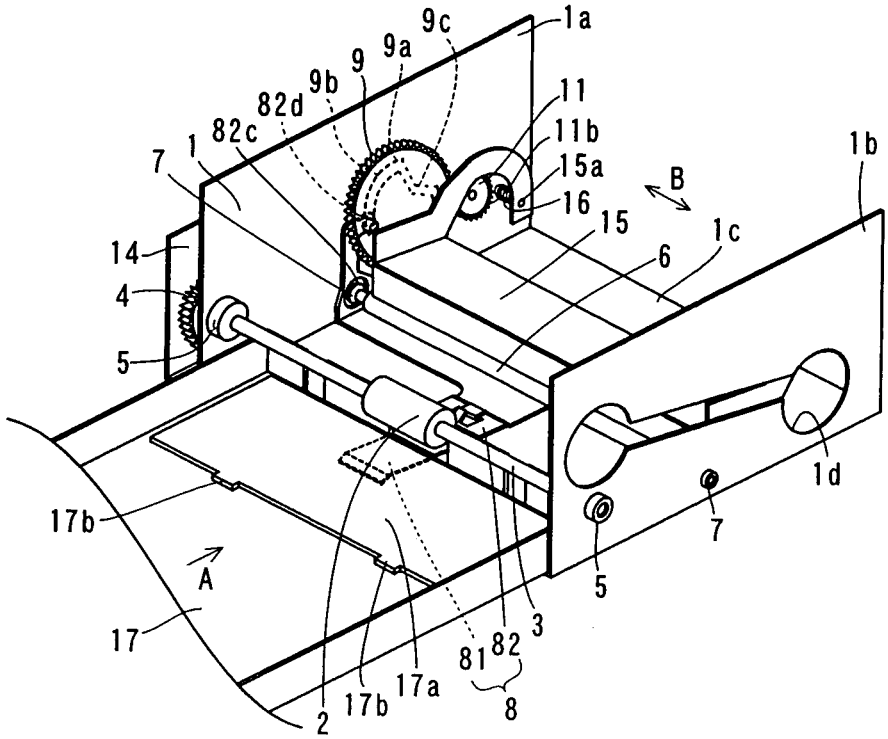
FIGS. 1 and 2 are perspective views showing the overall structure of a thermal transfer printer according to a first embodiment of the present invention.
Figure 2:
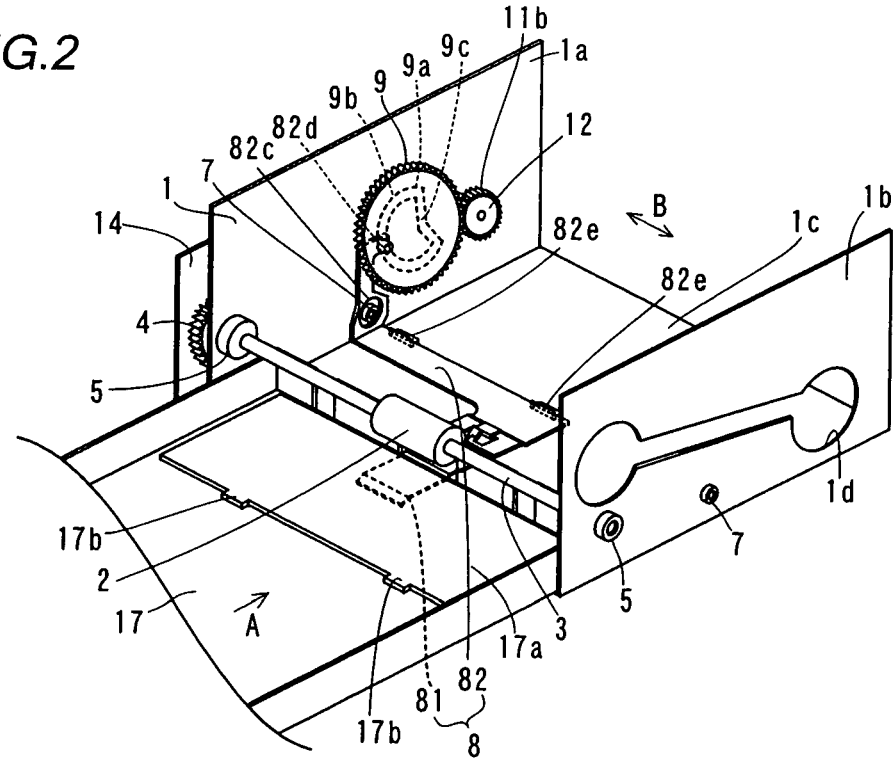

As shown in FIGS. 1 to 4, the thermal transfer printer according to the first embodiment comprises a chassis 1 of sheet metal, a paper feed roller 2 of rubber for feeding papers (not shown), a paper feed roller shaft 3 on which the paper feed roller 2 is mounted, a paper feed roller gear 4 for rotating the paper feed roller shaft 3, paper feed roller bearings 5, a platen roller 6 against which each of the papers (not shown) is pressed in printing, platen roller bearings 7, a push-up member 8 of metal (sheet metal) for pressing each of the papers against the paper feed roller 2, a drive gear 9, a motor 10 (see FIG. 3) serving as a drive source for driving the drive gear 9, an intermediate gear 11 (see FIG. 3) for transmitting the driving force of the motor 10 to the drive gear 9, another motor 12 (see FIG. 3) serving as a drive source for driving the paper feed roller 2, a plurality of intermediate gears 13 (see FIG. 3) for transmitting the driving force of the motor 12 to the paper feed roller gear 4, a motor bracket 14 of metal on which the motors 10 and 12 are mounted, a thermal head 15 and a torsion coil spring 16 urging the thermal head 15 away from the platen roller 6. A paper feed cassette 17 storing the papers (not shown) is detachably mounted on the thermal transfer printer, as shown in FIGS. 1 and 2.

Figure 3:
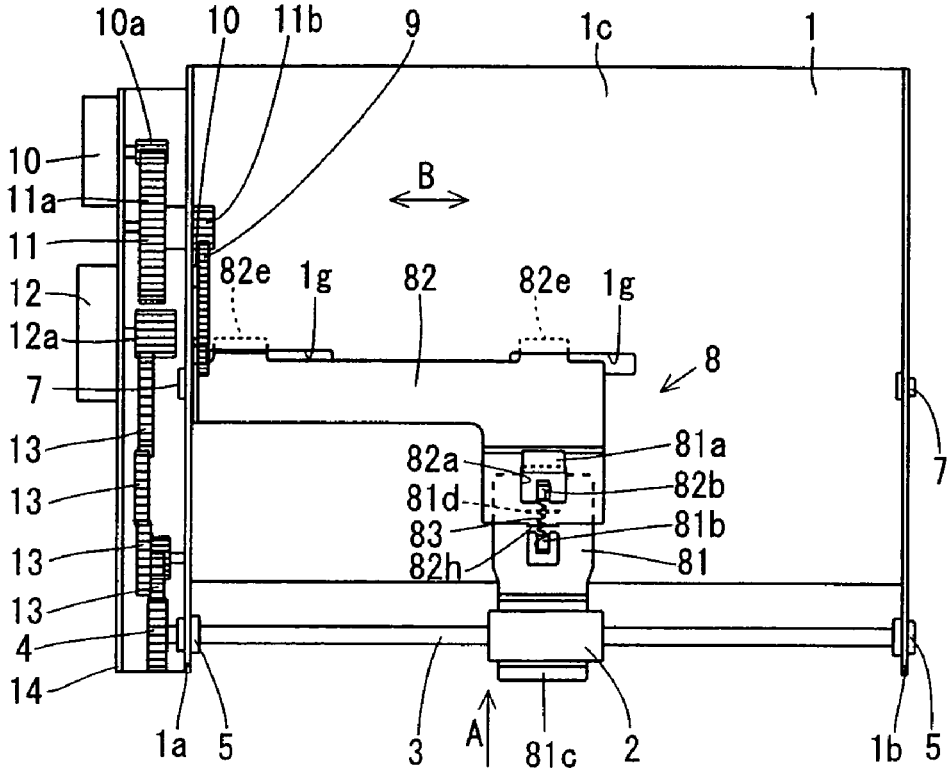
FIG. 3 is a plan view of the thermal transfer printer shown in FIG. 2.
Figure 4:
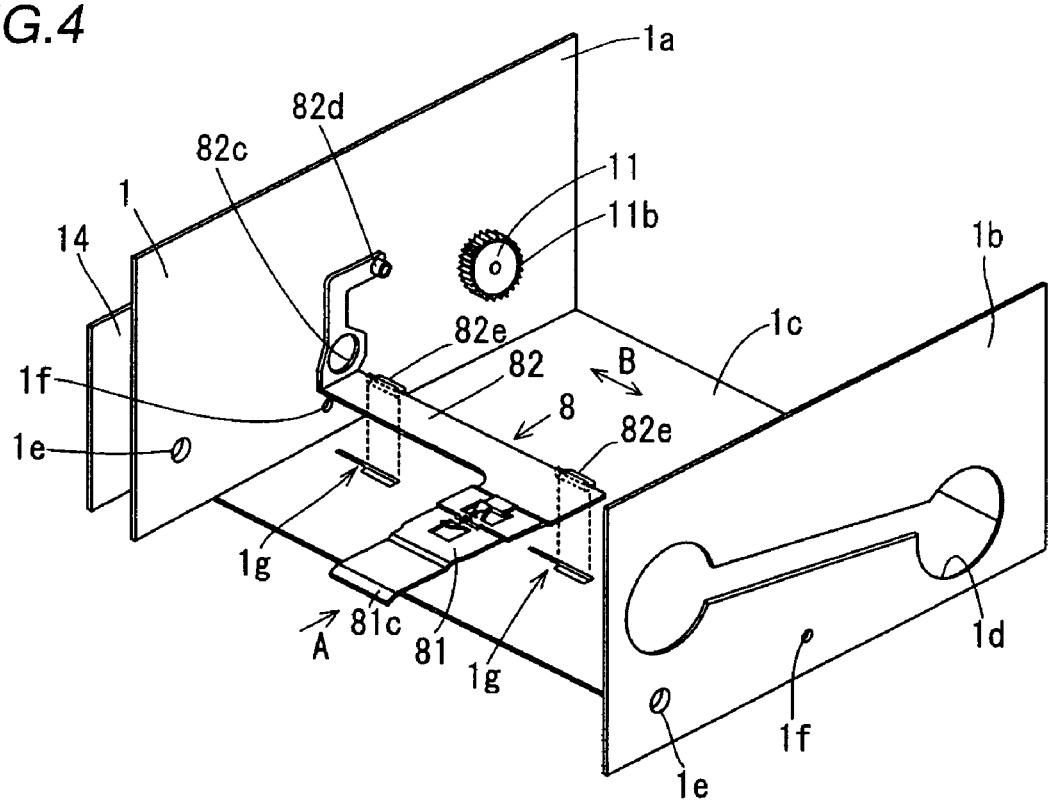
FIG. 4 is a perspective view showing the overall structure of the thermal transfer printer according to the first embodiment.
Figure 5:
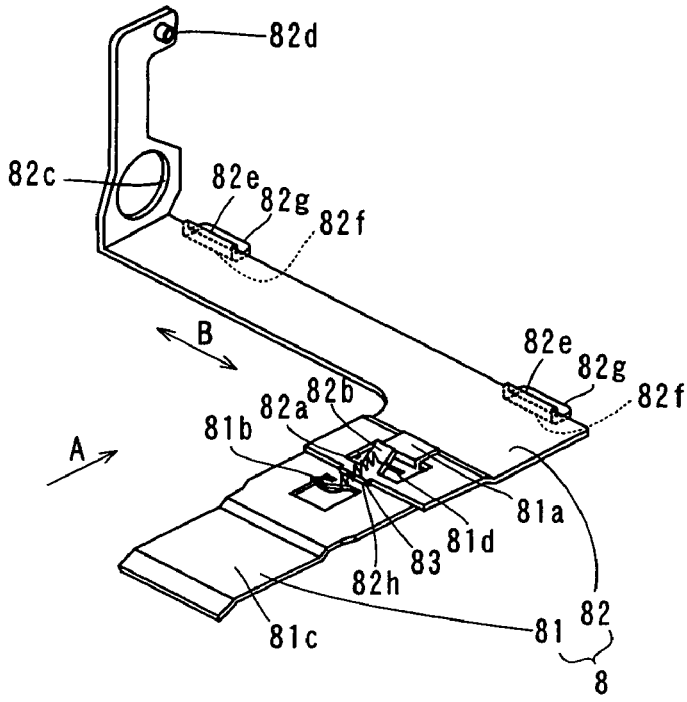
FIG. 5 is a perspective view showing a push-up member of the thermal transfer printer according to the first embodiment.
Figure 6:
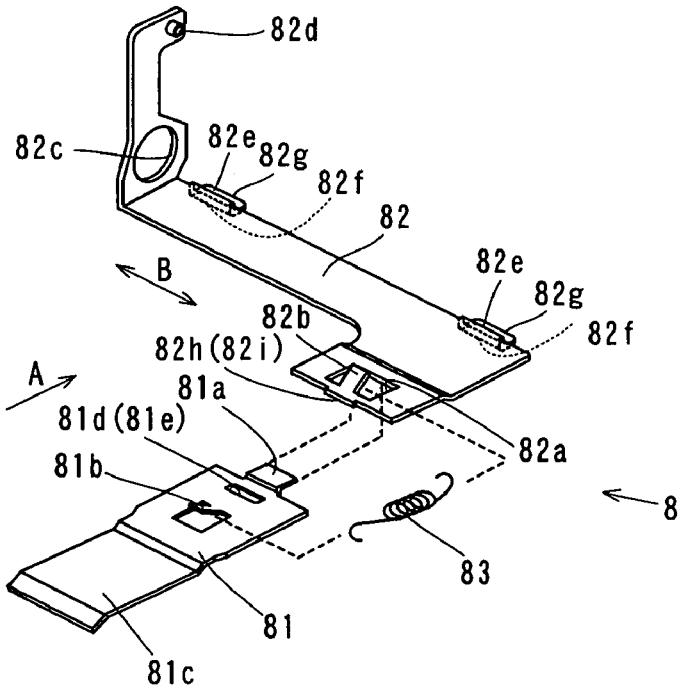
FIG. 6 is an exploded perspective view showing the push-up member of the thermal transfer printer according to the first embodiment.

The chassis 1 has a first side surface 1*a* on which the motor bracket 14 is mounted, a second side surface 1*b* and a bottom surface 1*c* connecting the first and second side surfaces 1*a* and 1*b* with each other, as shown in FIGS. 1 to 4. The second side surface 1*b* of the chassis 1 is provided with an ink sheet cartridge receiving hole 1*d* for receiving an ink sheet cartridge (not shown) storing an ink sheet. The first and second side surfaces 1*a* and 1*b* of the chassis 1 are provided with paper feed roller bearing mounting holes 1*e* and platen roller bearing mounting holes if respectively, as shown in FIG. 4. The paper feed roller bearings 5 rotatably supporting both ends of the paper feed roller 2 are mounted on the paper feed roller bearing mounting holes 1*e* of the first and second side surfaces 1*a* and 1*b* of the chassis 1. The platen roller bearings 7 rotatably supporting both ends of the platen roller 6 are mounted on the platen roller bearing mounting holes 1*f* of the first and second side surfaces 1*a* and 1*b* of the chassis 1. The bottom surface 1*c* of the chassis 1 is provided with a pair of holes 1*g* for rotatably mounting the push-up member 8, as shown in FIGS. 3 and 4.

The paper feed roller 2 is arranged above a press plate 17*a* of the paper cassette 17, as shown in FIGS. 1 to 3. This paper feed roller 2 is so formed as to carry the papers (not shown) in a paper feed direction (along arrow A) through rotation. The paper feed roller 2 is mounted in the vicinity of the central portion of the paper feed roller shaft 3. The paper feed roller bearings 5 mounted on the first and second side surfaces 1*a* and 1*b* of the chassis 1 rotatably support both ends of the paper feed roller shaft 3. The paper feed roller gear 4 is mounted on an end of the paper feed roller shaft 3 closer to the first side surface 1*a* in an unidling manner. The plurality of intermediate gears 13 engage with the paper feed roller gear 4, as shown in FIG. 3. The plurality of intermediate gears 13 are so arranged as to engage with a motor gear 12*a* of the motor 12.

According to the first embodiment, the push-up member 8 of metal (sheet metal) has a first push-up member 81 pressing each of the papers (not shown) against the paper feed roller 2 by pushing up the lower surface of the press plate 17*a* of the paper cassette 17 described later, a second push-up member 82 on which the first push-up member 81 is rotatably mounted and a helical tension spring 83 holding the first and second push-up members 81 and 82 with prescribed urging force. The helical tension spring 83 is an example of the "spring member" in the present invention.

The first push-up member 81 has an engaging portion 81*a* engaging with the second push-up member 82, a spring clip portion 81*b* and a press portion 81*c* pressing the lower surface of the press plate 17*a* described later, as shown in FIGS. 5 to 10. The second push-up member 82 has an engaging hole 82*a* engaging with the engaging portion 81*a* of the first push-up member 81, a spring clip portion 82*b*, a receiving hole 82*c* receiving the corresponding platen roller bearing 7, a cam engaging portion 82*d* engaging with a cam groove 9*a* (see FIGS. 1 and 2) of the drive gear 9 and a pair of rotating shaft portions 82*e* engaging with the pair of holes 1*g*, as shown in FIGS. 5 to 8, 11 and 12. The engaging portion 81*a* of the first push-up member 81 rotatably engages with the engaging hole 82*a* of the second push-up member 82, as shown in FIGS. 5 to 8. The engaging portion 81*a* of the first push-up member 81 is provided on a position close to a central portion of the first push-up member 81 in a direction (along arrow B) perpendicular to the paper feed direction, while the engaging hole 82*a* of the second push-up member 82 is provided on a position corresponding to the engaging portion 81*a* of the first push-up member 81 in the direction (along arrow B) perpendicular to the paper feed direction.

First and second ends of the helical coil spring 83 are mounted on the spring clip portions 81*b* and 82*b* of the first and second push-up members 81 and 82 respectively. The receiving hole 82*c* of the second push-up member 82 has an inner diameter larger than the outer diameter of the corresponding platen roller bearing 7, not to come into contact with the platen roller bearing 7 upon rotation of the push-up member 8, as shown in FIG. 2. The pair of rotating shaft portions 82*e* include a pair of shaft portions 82*f* and a pair of stop portions 82*g* for preventing the second push-up member 82 from upward displacement, as shown in FIGS. 5 to 8. The shaft portions 82*f* are orthogonally (perpendicularly) bent downward with respect to the horizontal surface of the second push-up member 82. The stop portions 82*g* are orthogonally bent with respect to the vertical surfaces of the shaft portions 82*f*, to protrude from the second push-up member 82 and extend in parallel with the horizontal surface thereof. Thus, the push-up member 8 has such a structure that the first push-up member 81 pushing up each of the papers (not shown) and bringing the same into contact with the paper feed roller 2 and the second push-up member 82 rotating about the pair of holes 1*g* rotatably engage with each other while the helical tension spring 83 connects the first and second push-up members 81 and 82 with each other. Also when the second push-up member 82 is rotated at the same angle for large and small numbers of papers (not shown) to be pushed up respectively, therefore, the push-up member 8 can press each of the papers (not shown) against the paper feed roller 2 with a proper pressure through expansion/contraction of the helical tension spring 83. The engaging portion 81*a* and the engaging hole 82*a* are examples of the "first engaging portion" and the "second engaging portion" in the present invention respectively.

Figure 7:
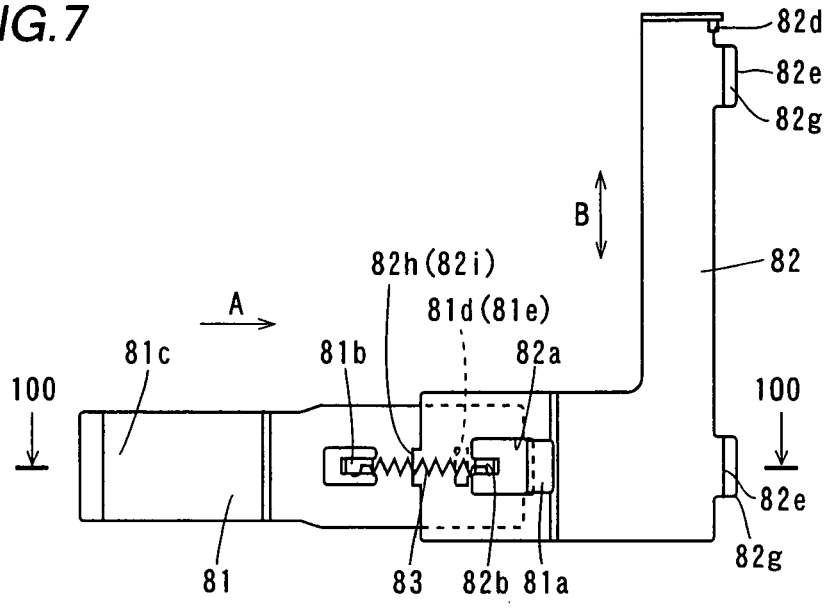
FIG. 7 is a plan view of the push-up member shown in FIG. 5.

According to the first embodiment, the first push-up member 81 is provided with a recess portion 81*d* rectangularly formed in plan view between the spring clip portion 81*b* and the engaging portion 81*a*, as shown in FIGS. 5 to 10. The second push-up member 82 is provided with a projecting portion 82*h* protruding from an end of the second push-up member 82 closer to the first push-up member 81 toward the first push-up member 81. This projecting portion 82*h*, provided closer to the first push-up member 81 than the engaging hole 82*a*, is rectangularly formed in plan view. As shown in FIG. 7, the recess portion 81*d* of the first push-up member 81 and the projecting portion 82*h* of the second push-up member 82 are provided on positions to be rotated in engagement with each other thereby inserting the engaging portion 81*a* into the engaging hole 82*a*. The interval W1 (see FIG. 9) between the recess portion 81*d* and the forward end of the engaging portion 81*a* is smaller than the interval W3 (see FIG. 11) between the projecting portion 81*d* and the engaging hole 82*a*, while the interval W2 (see FIG. 9) between the recess portion 81*d* and an end the first push-up member 81 is rendered larger than the interval W4 (see FIG. 11) between the projecting portion 82*h* and the engaging hole 82*a*. Thus, the engaging portion 81*a* can be fitted into the engaging hole 82*a* by simply rotating either the first push-up member 81 or the second push-up member 82 about the engaging position between the recess portion 81*d* and the projecting portion 82*h*. The width W5 (see FIG. 9) of the recess portion 81*d* of the first push-up member 81 in the direction (along arrow B) perpendicular to the paper feed direction is rendered slightly larger than the width W6 (see FIG. 11) of the projecting portion 82*h* of the second push-up member 82 in the direction (along arrow B) perpendicular to the paper feed direction, so that the recess portion 81*d* of the first push-up member 81 and the projecting portion 82*h* of the second push-up member 82 are engageable with each other and the recess portion 81*d* of the first push-up member 81 is hardly movable with respect to the projecting portion 82*h* of the second push-up member 82 in the direction (along arrow B) perpendicular to the paper feed direction in this engaging state. An engaging edge 81*e* of the recess portion 81*d* engaging with the projecting portion 82*h* and an engaging edge 82*i* of the projecting portion 82*h* engaging with the recess portion 81*d* are so formed as to extend in a direction perpendicular to the rotational direction of the first or second push-up member 81 or 82 in the engaging state of the recess portion 81*d* and the projecting portion 82*h*. In other words, the recess portion 81*d* and the projecting portion 82*h* are engaged with each other by linearly bringing the engaging edges 81*e* and 82*i* into contact with each other along the aforementioned direction perpendicular to the rotational direction. The length of the engaging edge 82*i* (width W6 of the projecting portion 82*h* in the direction (along arrow B) perpendicular to the paper feed direction) is rendered larger than the protruding length W7 (see FIG. 11) of the projecting portion 82*h*. The recess portion 81*d* and the projecting portion 82*h* are examples of the "first assembly engaging portion" and the "second assembly engaging portion" in the present invention respectively. The engaging edges 81*e* and 82*i* are examples of the "first engaging section" and the "second engaging section" in the present invention respectively.

As shown in FIGS. 1 to 3, the drive gear 9 is mounted on the first side surface 1*a* of the chassis 2. As shown in FIG. 2, the cam groove 9*a* coming into contact with the cam engaging portion 82*d* of the second push-up member 82 is provided on a side (back surface) of the drive gear 9 closer to the first side surface 1*a*. The cam groove 9*a* has a circular groove portion 9*b* and a concave groove portion 9*c*. When the drive gear 9 rotates while the cam engaging portion 82*d* of the second push-up member 82 engages with the circular groove portion 9*b* and the concave groove portion 9*c*, the second push-up member 82 rotates about the pair of rotating shaft portions 82*e*. As shown in FIG. 3, the motor 10 has a motor gear 10*a*. The intermediate gear 11, mounted on the first side surface 1*a* of the chassis 1, has a large-diameter gear portion 11*a* and a small-diameter gear portion 11*b*, as shown in FIG. 3. The motor gear 10*a* and the large-diameter gear portion 11*a* of the intermediate gear 11 engage with each other, while the small-diameter gear portion 11*b* of the intermediate gear 11 engages with the drive gear 9. Therefore, the driving force of the motor 10 is transmitted to the push-up member 8 through three gears, i.e. the motor gear 10*a*, the intermediate gear 11 and the drive gear 9. The thermal head 15, rotating about a support shaft 15*a*, has a function of printing images on the papers (not shown).

As shown in FIG. 2, the press plate 17*a* of resin is provided on a prescribed position of the paper cassette 17. This press plate 17*a* is rendered rotatable about a fulcrum portion 17*b*. Further, the press plate 17*a* is pushed up by the press portion 81*c* of the first push-up member 81 from the state shown in FIG. 17, thereby pressing each of papers 30 loaded on the press plate 17*a* against the paper feed roller 2, as shown in FIG. 18.

A method of assembling the push-up member 8 of the thermal transfer printer according to the first embodiment is described with reference to FIGS. 8 and 13 to 16.

Figure 8:
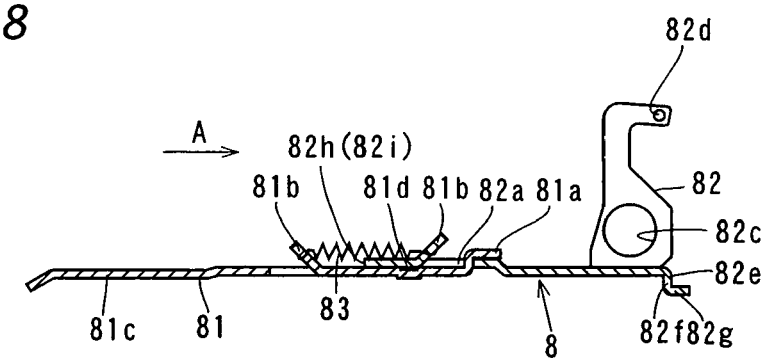
FIG. 8 is a sectional view taken along the line 100-100 in FIG. 7.
Figure 9:
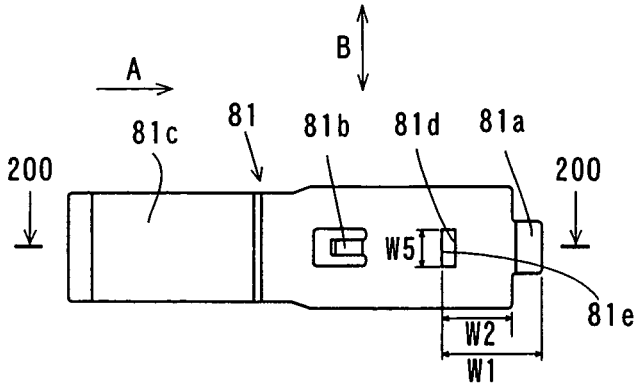
FIG. 9 is a plan view showing a first push-up member of the push-up member of the thermal transfer printer according to the first embodiment.
Figure 10:
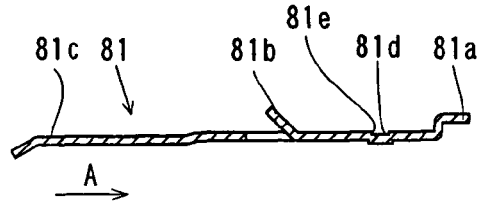
FIG. 10 is a sectional view taken along the line 200-200 in FIG. 9.
Figure 11:
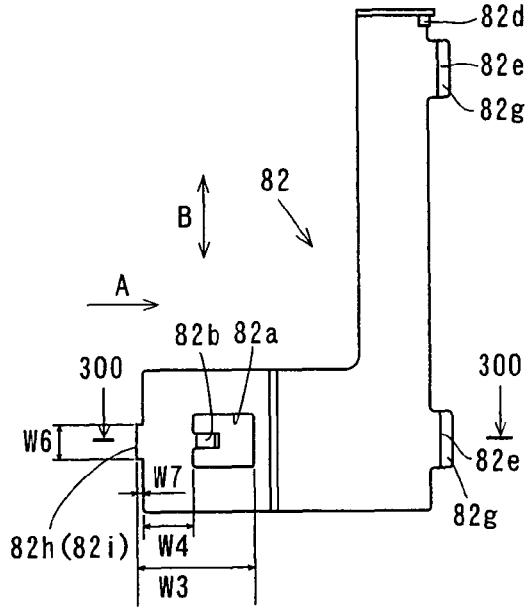
FIG. 11 is a plan view showing a second push-up member of the push-up member of the thermal transfer printer according to the first embodiment.
Figure 12:
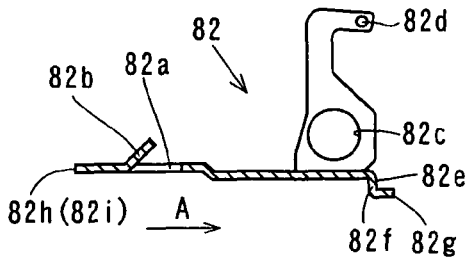
FIG. 12 is a sectional view taken along the line 300-300 in FIG. 11.
Figure 13:
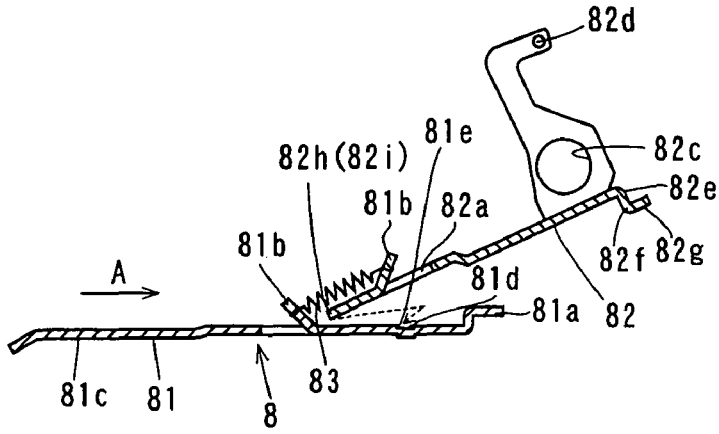
FIGS. 13 to 16 illustrate a method of assembling the push-up member of the thermal transfer printer according to the first embodiment.
Figure 14:
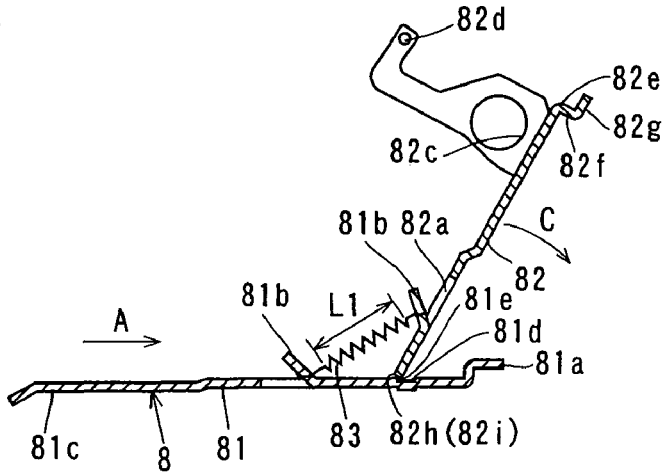
Figure 15:
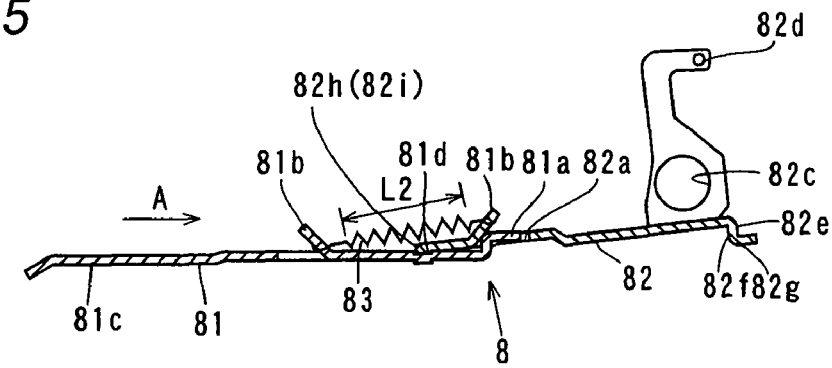
Figure 16:
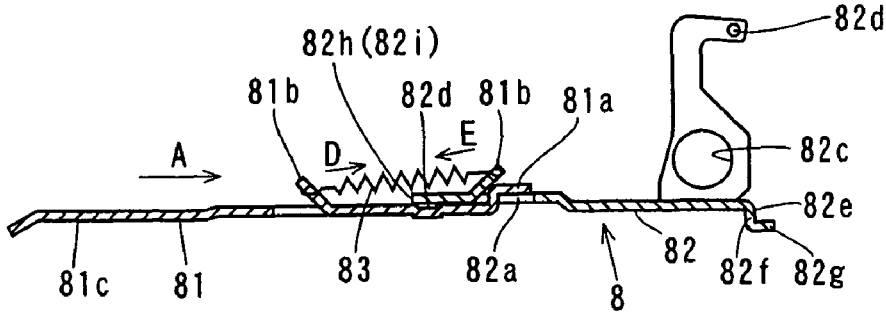

As shown in FIG. 13, the first and second ends of the helical tension spring 83 are mounted on the spring clip portions 81*b* and 82*b* respectively. Then, the engaging edge 82*i* of the projecting portion 82*h* of the second push-up member 82 is engaged with the engaging edge 81*e* of the recess portion 81*d* of the first push-up member 81. Thereafter the second push-up member 82 is rotated about the engaging position between the engaging edges 81*e* and 82*i* along arrow C in FIG. 14. The positions of the engaging portion 81*a* of the first push-up member 81 and the engaging hole 82*a* of the second push-up member 82 in the direction (along arrow B) perpendicular to the paper feed direction correspond to each other, while the positions of the recess portion 81*d* of the first push-up member 81 and the projecting portion 82*h* of the second push-up member 82 in the direction (along arrow B) perpendicular to the paper feed direction correspond to each other. When the second push-up member 82 is rotated about the engaging position between the engaging edges 81*e* and 82*i*, therefore, the engaging portion 81*a* enters the engaging hole 82*a*, as shown in FIG. 15. When the engaging portion 81*a* of the first push-up member 81 completely enters the engaging hole 82*a* of the second push-up member 82, the first and second push-up members 81 and 82 are pulled along arrows D and E respectively due to the urging force of the helical tension spring 83, as shown in FIG. 16. Then, the engaging portion 81*a* engages with the engaging hole 82*a*, as shown in FIG. 8. According to the first embodiment, a spring length L1 (see FIG. 14) of the helical tension spring 83 necessary for engaging the recess portion 81*d* of the first push-up member 81 and the projecting portion 82*h* of the second push-up member 82 with each other is smaller than another spring length L2 (see FIG. 15) of the helical tension spring 83 necessary for engaging the engaging portion 81*a* and the engaging hole 82*a* with each other. Further, the principle of lever is utilized about the engaging position between the recess portion 81*d* and the projecting portion 82*h*, whereby the push-up member 8 can be simply assembled without a jig or the like also when the helical tension sprint 83 has a large spring constant and strong urging force.

A paper feed operation of the thermal transfer printer according to the first embodiment is described with reference to FIGS. 3 and 17 to 19.

Figure 17:
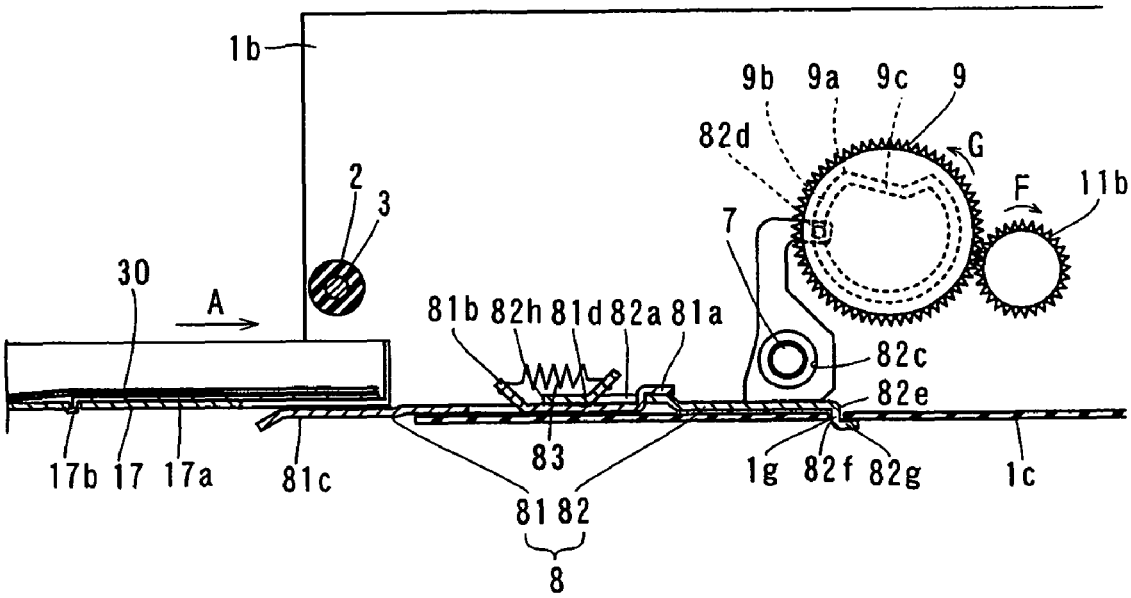
FIGS. 17 to 19 illustrate a paper feeding operation of the thermal transfer printer according to the first embodiment.
Figure 18:
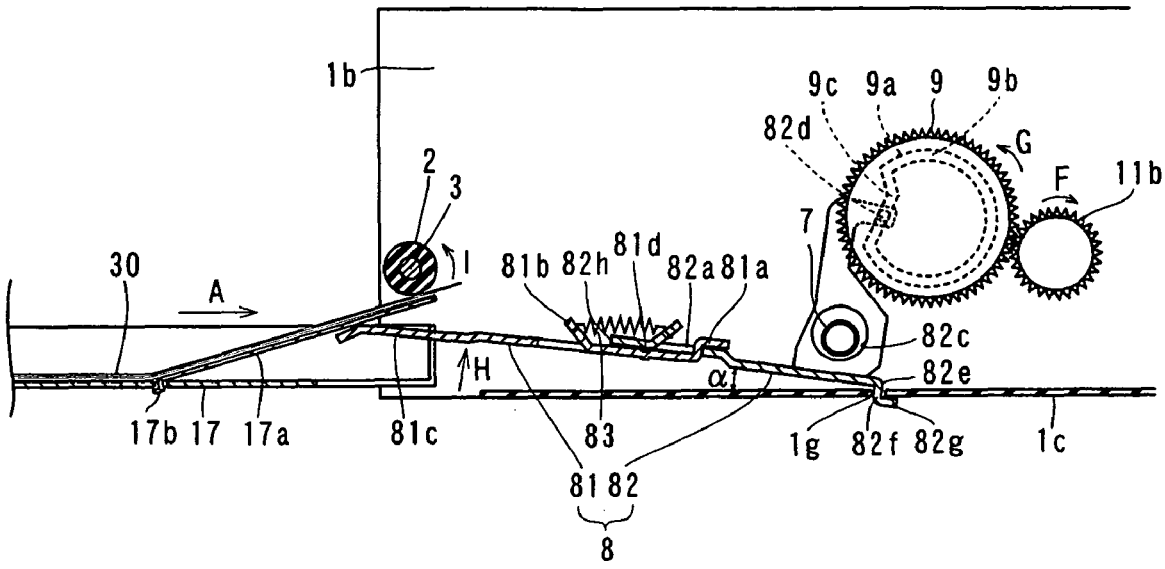
Figure 19:
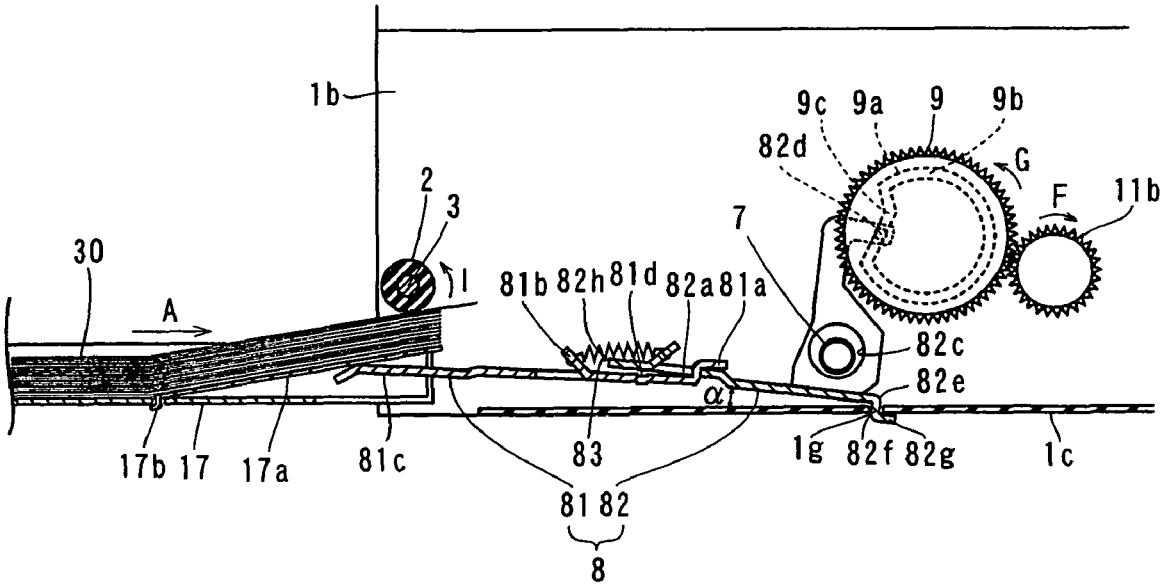

As shown in FIG. 17, the small-diameter gear 11*b* of the intermediate gear 11 rotates along arrow F due to the driving force of the motor 10 (see FIG. 3), to rotate the drive gear 9 along arrow G. Thus, the cam engaging portion 82*d* of the second push-up member 82, engaging with the circular groove portion 9*b* of the cam groove 9*a* of the drive gear 9 as shown in FIG. 17, engages with the concave groove portion 9*c* of the cam groove 9*a* of the drive gear 9 as shown in FIG. 18. Thus, the second push-up member 82 having the rotating shaft portions 82*e* mounted on the holes 1*g* rotates by a prescribed angle α along arrow H about the shaft portions 82*f* serving as rotation centers. Therefore, the press portion 81*c* of the first push-up member 81 lifts up the press plate 17*a* of the paper cassette 17, thereby pressing each of the papers 30 supported by the press plate 17*a* against the paper feed roller 2. Then, the driving force of the motor 12 is transmitted to the paper feed roller gear 4 through the motor gear 12*a* and the plurality of intermediate gears 13, as shown in FIG. 3. Thus, the paper feed roller shaft 3 and the paper feed roller 2 rotate along arrow I as shown in FIG. 18, thereby carrying the papers 30 in the paper feed direction (along arrow A). According to the first embodiment, the second push-up member 82 also rotates by the prescribed angle α when the press plate 17*a* of the paper feed cassette 17 is loaded with a large number of papers, as shown in FIG. 19. In this case, the helical tension spring 83 so expands that the first push-up member 81 presses each of the papers 30 against the paper feed roller 2 with proper pressing force.

According to the first embodiment, as hereinabove described, the first push-up member 81 can be movably mounted on the second push-up member 82 in the structure connecting the first and second push-up members 81 and 82 with each other through the helical tension spring 83 by rotatably engaging the engaging portion 81*a* of the first push-up member 81 in the engaging hole 82*a* of the second push-up member 82 and mounting the first and second ends of the helical tension sprint 83 on the spring clip portions 81*b* and 82*b* of the first and second push-up members 81 and 82 respectively. Thus, the first push-up member 81 can be rotated about the engaging hole 82*a* of the second push-up member 82 without another component such as a rotating shaft in the structure connecting the first and second push-up members 81 and 82 with each other through the helical tension spring 83, whereby the number of components can be inhibited from increase as compared with a case of additionally providing a rotating shaft or the like for rotating the first push-up member 81. Also when the number of the papers 30 varies in the structure connecting the first and second push-up members 81 and 82 with each other through the helical tension spring 83, the push-up member 8 can press each of the papers 30 against the paper feed roller 2 with a proper pressure through expansion/contraction of the helical tension spring 83 in response to the number of the papers 30, to require no electrical control for changing the quantity of rotation of the push-up member 8 in response to the number of the papers 30.

According to the first embodiment, the push-up member 8 can be easily assembled by engaging the recess portion 81*d* of the first push-up member 81 and the projecting portion 82*h* of the second push-up member 82 with each other while mounting the first and second ends of the helical tension spring 83 on the first and second push-up members 81 and 82 respectively and rotating at least either the first push-up member 81 or the second push-up member 82 about the engaging position between the recess portion 81*d* and the projecting portion 82*h* against the urging force of the helical tension spring 83 thereby engaging the engaging portion 81*a* and the engaging hole 82*e* with each other. Thus, the push-up member 8 can be assembled with no jig or the like also when the helical tension spring 83 has such a large spring constant that the same cannot be expanded without a jig or the like.

According to the first embodiment, the recess portion 81*d* of the first push-up member 81 and the projecting portion 82*h* of the second push-up member 82 are provided on positions to be rotated in engagement with each other thereby engaging the engaging portion 81*a* and the engaging hole 82*a* with each other so that the engaging portion 81*a* and the engaging hole 82*a* are engaged with each other by simply rotating at least either the first push-up member 81 or the second push-up member 82 about the engaging position between the recess portion 81*d* of the first push-up member 81 and the projecting portion 82*h* of the second push-up member 82, whereby the push-up member 8 can be easily assembled.

According to the first embodiment, the recess portion 81*d* and the projecting portion 82*h* are provided as the first and second assembly engaging portions respectively, whereby the first and second assembly engaging portions can be simply shaped and the recess portion 81*d* and the projecting portion 82*h* can be easily engaged with each other.

According to the first embodiment, the width of the recess portion 81*d* of the first push-up member 81 in the direction (along arrow B) perpendicular to the paper feed direction is so sized that the recess portion 81*d* is engageable with the projecting portion 82*h* of the second push-up member 82 and the projecting portion 82*h* of the second push-up member 82 is hardly movable with respect to the recess portion 81*d* of the first push-up member 81 in the direction (along arrow B) perpendicular to the paper feed direction in this engaging state, whereby the recess portion 81*d* of the first push-up member 81 and the projecting portion 82*h* of the second push-up member 82 do not deviate in the direction (along arrow B) perpendicular to the paper feed direction when at least either the first push-up member 81 or the second push-up member 82 is rotated. Thus, the push-up member 8 can be easily assembled.

According to the first embodiment, the engaging edges 81*e* and 82*i* of the recess portion 81*d* and the projecting portion 82*h* are linearly brought into contact with and engaged with each other along the direction perpendicular to the rotational direction of the second push-up member 82 so that the second push-up member 82 can be rotated about the linear engaging portion between the engaging edges 81*e* and 82*i*, whereby the rotational direction of the second push-up member 82 is inhibited from deviation. Thus, the second push-up member 82 can be easily rotated in the aforementioned rotational direction.

According to the first embodiment, the length W6 of the engaging edge 82*i* of the projecting portion 82*h* in the aforementioned direction perpendicular to the rotational direction is rendered larger than the protruding length W7 of the projecting portion 82*h*, whereby the mechanical strength of the projecting portion 82*h* can be increased with respect to a load applied to the projecting portion 82*h* upon rotation of the second push-up member 82. Thus, the projecting portion 82*h* can be inhibited from deformation or breakage.

Second Embodiment

Referring to FIGS. 20 to 26, a thermal transfer printer according to a second embodiment of the present invention has a first push-up member 91 provided with a projecting portion 91*d* and a second push-up member 92 provided with a projecting portion 92*h* and a relief portion 92*i*, dissimilarly to the aforementioned first embodiment. The shape of the thermal transfer printer according to the second embodiment is similar to that of the thermal transfer printer according to the first embodiment, except the projecting portions 91*d* and 92*h* and the relief portion 92*i*.

Figure 20:
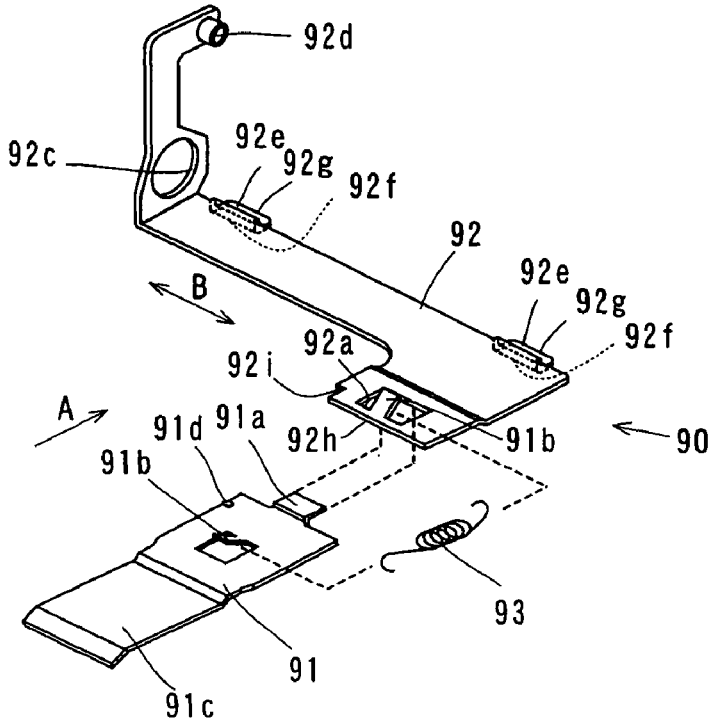
FIG. 20 is an exploded perspective view showing a push-up member of a thermal transfer printer according to a second embodiment of the present invention.
Figure 21:
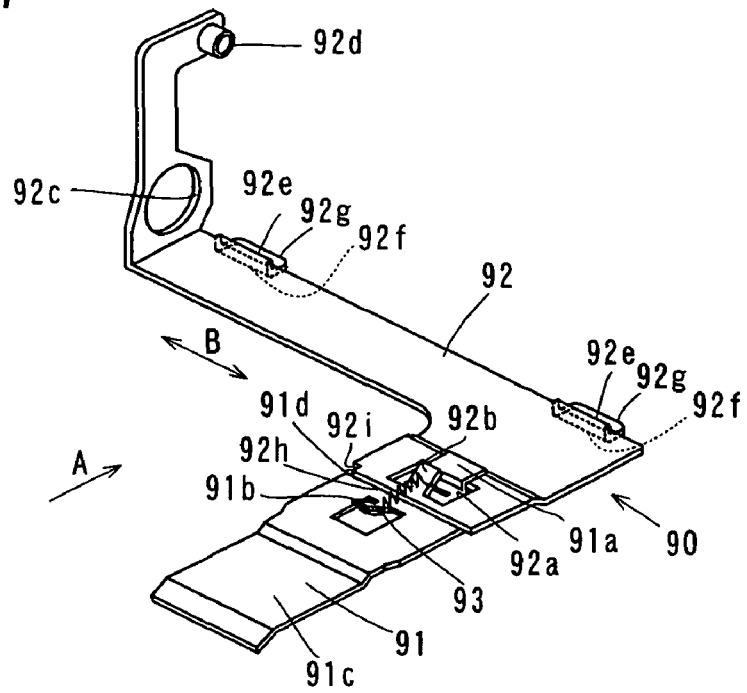
FIG. 21 is a perspective view showing the push-up member of the thermal transfer printer according to the second embodiment.
Figure 22:
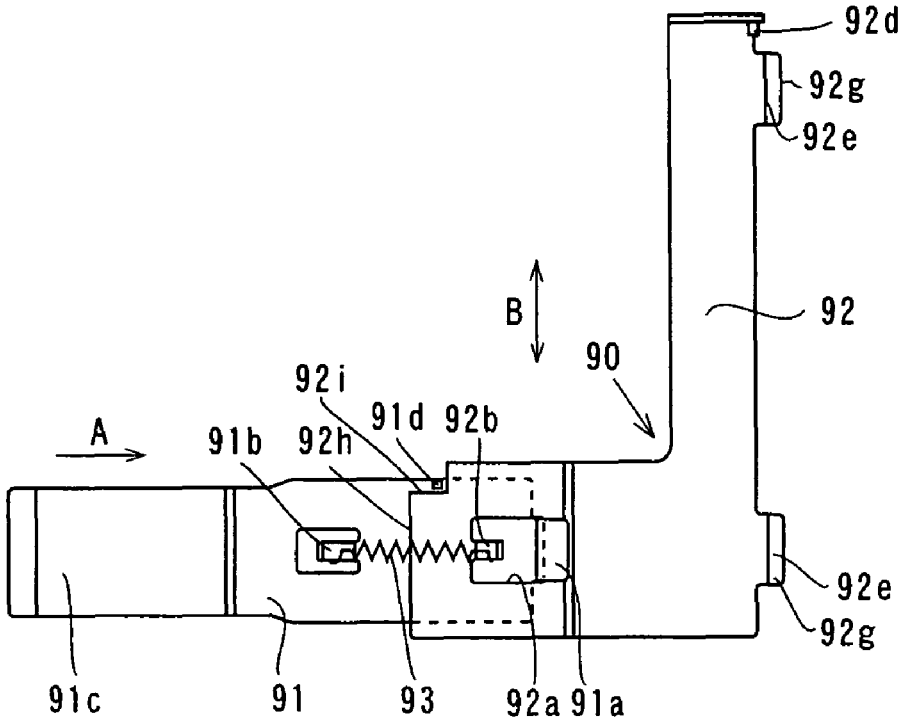
FIG. 22 is a plan view of the push-up member shown in FIG. 21.

A push-up member 90 of the thermal transfer printer according to the second embodiment is constituted of the first and second push-up members 91 and 92 and a helical tension spring 93. Similarly to the first embodiment, the first push-up member 91 has an engaging portion 91*a* engaging with the second push-up member 92, a spring clip portion 91*b* and a press portion 91*c* pressing the lower surface of a press plate 17*a*, as shown in FIGS. 20 to 22. The second push-up member 92 includes an engaging hole 92*a* engaging with the engaging portion 91*a* of the first push-up member 91, a spring clip portion 92*b*, a receiving hole 92*c* receiving a corresponding platen roller bearing 7 (see FIGS. 1 and 2), a cam engaging portion 92*d* engaging with a cam groove 9*a* (see FIGS. 1 and 2) of a drive gear 9 and a pair of rotating shaft portions 92*e* engaging with a pair of holes 1*g*. The pair of rotating shaft portions 92*e* include a pair of shaft portions 92*f* and a pair of stop portions 92*g* for preventing the second push-up member 92 from upward displacement.

According to the second embodiment, the first push-up member 91 is provided with the projecting portion 91*d* in the vicinity of an end between the spring clip portion 91*b* and the engaging portion 91*a* in a direction (along arrow B) perpendicular to a paper feed direction. The second push-up member 92 is further provided with the projecting portion 92*h* on an end closer to the first pushup member 91, for engaging (coming into contact) with the first pushup member 91 in assembling. The second push-up member 92 is additionally provided with the relief portion 92*i* for relieving the projecting portion 91*d* on a position corresponding to the projecting portion 91*d* of the first push-up member 91 after assembling. The relief portion 92*i*, provided adjacently to the projecting portion 92*h*, is notched. According to the second embodiment, the projecting portions 91*d* and 92*h* of the first and second push-up members 91 and 92 engage with each other in assembling. The projecting portions 91*d* and 92*h* are examples of the "first assembly engaging portion" and the "second assembly engaging portion" in the present invention respectively.

A method of assembling the push-up member 90 of the thermal transfer printer according to the second embodiment is described with reference to FIGS. 23 to 26.

Figure 23:
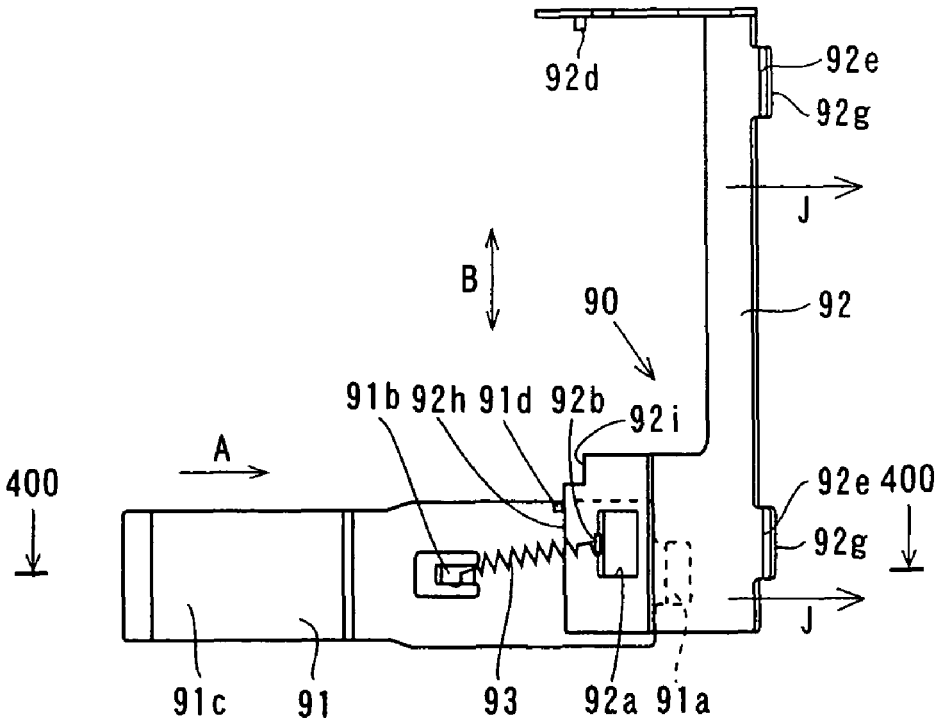
FIG. 23 is a plan view for illustrating a method of assembling the push-up member of the thermal transfer printer according to the second embodiment.
Figure 24:
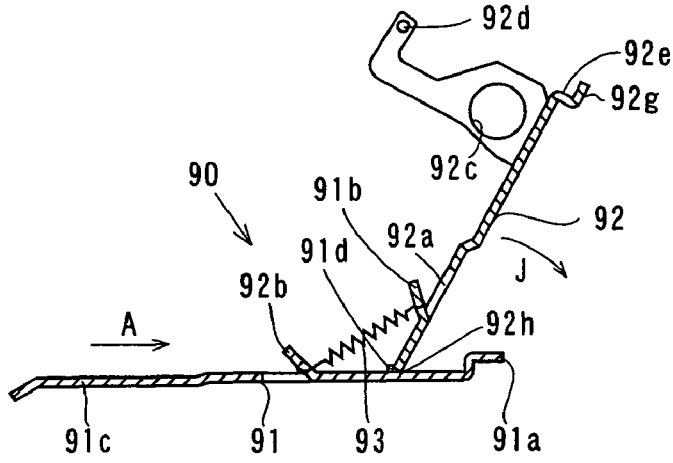
FIG. 24 is a sectional view taken along the line 400-400 in FIG. 23.
Figure 25:
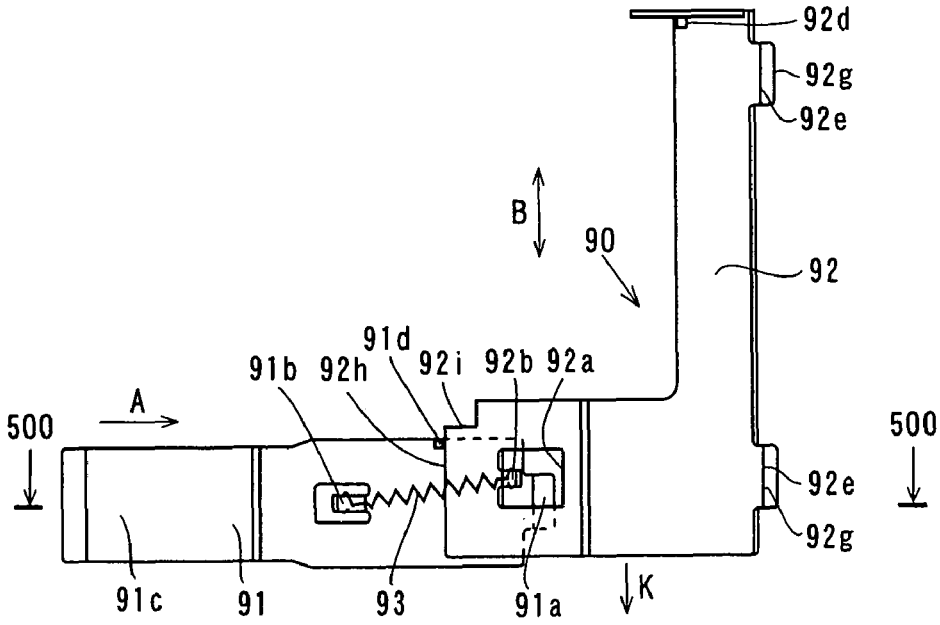
FIG. 25 is a plan view for illustrating the method of assembling the push-up member of the thermal transfer printer according to the second embodiment.
Figure 26:
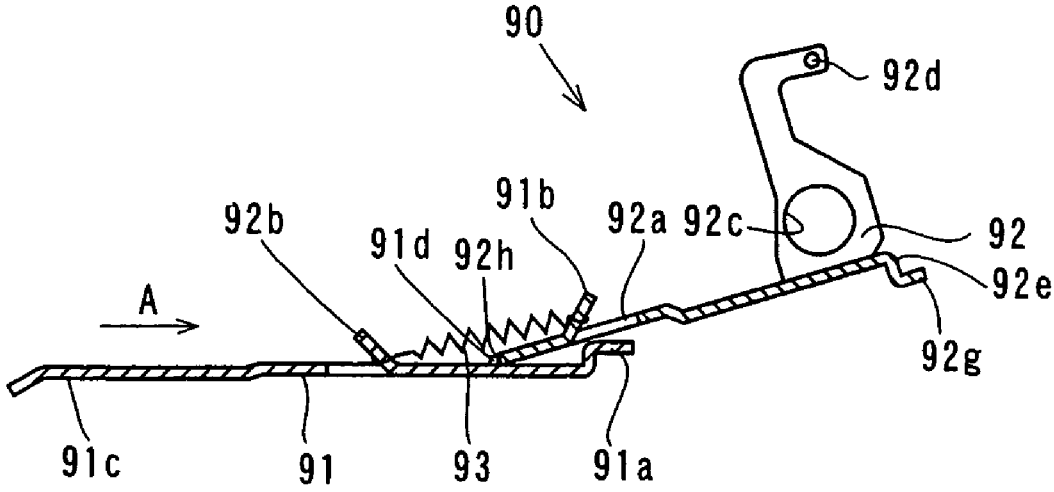
FIG. 26 is a sectional view taken along the line 500-500 in FIG. 25.

As shown in FIGS. 23 and 24, first and second ends of the helical tension sprint 93 are mounted on the spring clip portions 91*b* and 92*b* respectively. Then, the projecting portions 91*d* and 92*h* of the first and second push-up members 91 and 92 are engaged (brought into contact) with each other. At this time, the engaging portion 91*a* of the first push-up member 91 and the engaging hole 92*a* of the second push-up member 92 deviate from each other in the direction (along arrow B) perpendicular to the paper feed direction, due to noncorrespondence between the positions of the projecting portions 91*d* and 92*h* in the direction (along arrow B) perpendicular to the paper feed direction. Then, the second push-up member 92 is rotated along arrow J in FIG. 24 about the engaging position between the projecting portions 91*d* and 92*h* against the urging force of the helical tension spring 93, so that the engaging portion 91*a* of the first push-up member 91 reaches a position deviating from that of the engaging hole 92*a* of the second push-up member 92 by a prescribed distance in the direction (along arrow B) perpendicular to the paper feed direction, as shown in FIGS. 25 and 26. Thereafter the second push-up member 92 is so slid along arrow K in FIG. 25 as to engage the engaging portion 91*a* and the engaging hole 92*a* with each other. At this time, the projecting portion 91*d* of the first push-up member 91 is located on a relieving area (notched area) formed by the relief portion 92*i* of the second push-up member 92, not to interfere with the second push-up member 92.

According to the second embodiment, as hereinabove described, the first and second push-up members 91 and 92 are provided with the projecting portions 91*d* and 92*h* respectively while the relief portion 92*i* is provided on the position corresponding to the position of the projecting portion 91*d* in the direction (along arrow B) perpendicular to the paper feed direction, whereby the engaging portion 91*a* and the engaging hole 92*a* can be engaged with each other by engaging the projecting portions 91*d* and 92*h* with each other while mounting the first and second ends of the helical tension spring 93 on the first and second push-up members 91 and 92 respectively, rotating at least either the first push-up member 91 or the second push-up member 92 about the engaging position between the projecting portions 91*d* and 92*h* against the urging force of the helical tension spring 93 and thereafter sliding the second push-up member 92 in the direction (along arrow B) perpendicular to the paper feed direction thereby relieving the projecting portion 91*d* constituting the first assembly engaging portion to the relief portion 92*i*. Further, the projecting portion 91*d* of the first push-up member 91 can be located on the relieving area formed by the relief portion 92*i* of the second push-up member 92 after assembling the push-up member 90, to be inhibited from interfering with the second push-up member 92. Thus, the push-up member 90 can be so assembled as to correctly operate.

Although the present invention has been described and illustrated in detail, it is clearly understood that the same is by way of illustration and example only and is not to be taken by way of limitation, the spirit and scope of the present invention being limited only by the terms of the appended claims.

For example, while each of the aforementioned first and second embodiments is applied to the thermal transfer printer employed as an exemplary image generating apparatus, the present invention is not restricted to this but is also applicable to another image generating apparatus such as an ink jet printer or a later printer.

While the thermal transfer printer according to the first embodiment is provided with the single recess portion 81*d* (first assembly engaging portion) and the single projecting portion 82*h* (second assembly engaging portion), the present invention is not restricted to this but the thermal transfer printer may alternatively be provided with a plurality of recess portions 81*d* (first assembly engaging portions) and a plurality of projecting portions 82*h* (second assembly engaging portions).

While the recess portion 81*d* is provided as the first assembly engaging portion of the first push-up member 81 in the thermal transfer printer according to the first embodiment, the present invention is not restricted to this but a hole may alternatively be provided as the first assembly engaging portion of the first push-up member 81.

What is claimed is:

1. An image generating apparatus comprising:

a paper feed roller carrying a paper in a paper feed direction; and a push-up member for pushing up said paper and bringing said paper into contact with said paper feed roller, wherein said push-up member includes:

a first push-up member, integrally having a first engaging portion, a first spring clip portion and a first assembly engaging portion provided between said first spring clip portion and said first engaging portion, a second push-up member integrally having a second engaging portion rotatably engaging with said first engaging portion of said first push-up member, a second assembly engaging portion rotatably engaging with said first assembly engaging portion and a second spring clip portion, and a spring member mounted on said first spring clip portion of said first push-up member and said second spring clip portion of said second push-up member, wherein during assembly of said push-up member, said first engaging portion and said second engaging portion are engaged with each other by engaging said first assembly engaging portion and said second assembly engaging portion with each other while mounting first and second ends of said spring member on said first spring clip portion of said first push-up member and said second spring clip portion of said second push-up member respectively and at least rotating either said first push-up member or said second push-up member about an engaging position between said first assembly engaging portion and said second assembly engaging portion against an urging force of said spring member pulling said first spring clip portion and said second spring clip portion.

2. The image generating apparatus according to claim 1, wherein said first assembly engaging portion of said first push-up member and said second assembly engaging portion of said second push-up member are provided on positions to be rotated in engagement with each other, thereby engaging said first engaging portion and said second engaging portion with each other.

3. The image generating apparatus according to claim 1, wherein said first assembly engaging portion of said first push-up member includes a recess portion, said second assembly engaging portion of said second push-up member includes a projecting portion engaging with said recess portion, and said projecting portion is formed such that at least either said first push-up member or said second push-up member is capable of rotating about said recess portion while maintaining a state that said projecting portion is engaged with said recess portion.

4. The image generating apparatus according to claim 3, wherein said recess portion includes a first engaging section, said projecting portion includes a second engaging section for rotatably engaging with said recess portion, and said first engaging section of said projecting portion and said second engaging section of said recess portion are so formed as to extend in a first direction perpendicular to a direction of said urging force of said spring member.

5. The image generating apparatus according to claim 4, wherein a length of said second engaging section of said projecting portion along said first direction perpendicular to said direction of said urging force is larger than a protruding length of said projecting portion along said direction of said urging force.

6. The image generating apparatus according to claim 4, wherein said recess portion and said projecting portion are rectangularly formed.

7. The image generating apparatus according to claim 1, wherein said second engaging portion includes a receiving hole having a size capable of receiving said first engaging portion, and said second engaging portion is so formed that said first engaging portion and said second engaging portion are rotatably engaged with each other by engaging said first assembly engaging portion and said second assembly engaging portion with each other and rotating at least said first push-up member or said second push-up member about said engaging position between said first assembly engaging portion and said second assembly engaging portion against said urging force of said spring member pulling said first spring clip portion and said second spring clip portion, thereby inserting said first engaging portion into said receiving hole of said second engaging portion.

8. The image generating apparatus according to claim 1, wherein said first assembly engaging portion is provided between said first spring clip portion and said first engaging portion, and said second assembly engaging portion is provided closer to said first push-up member than said second engaging portion.

9. The image generating apparatus according to claim 1, wherein said first assembly engaging portion of said first push-up member includes a projecting portion engaging with said second assembly engaging portion, and said second push-up member includes a relief portion provided on a position corresponding to said projecting portion of said first push-up member for relieving said projecting portion in a state that said second engaging portion of said second push-up member is engaging with said first engaging portion of said first push-up member.

10. An image generating apparatus comprising:

a paper feed roller carrying a paper in a paper feed direction; and a push-up member for pushing up said paper and bringing said paper into contact with said paper feed roller, wherein said push-up member includes:

a first push-up member, integrally having a first engaging portion, a first spring clip portion and a first assembly engaging portion formed by a recess portion provided between said first spring clip portion and said first engaging portion, a second push-up member integrally having a second engaging portion rotatably engaging with said first engaging portion of said first push-up member, a second assembly engaging portion formed by a projecting portion rotatably engaging with said recess portion forming said first assembly engaging portion and a second spring clip portion, and a spring member mounted on said first spring clip portion of said first push-up member and said second spring clip portion of said second push-up member, wherein:

said recess portion of said first push-up member and said projecting portion of said second push-up member are provided on positions to be rotated in engagement with each other, thereby engaging said first engaging portion and said second engaging portion with each other, and wherein during assembly of said push-up member, said first engaging portion and said second engaging portion are engaged with each other by engaging said recess portion and said projecting portion with each other while mounting first and second ends of said spring member on said first spring clip portion of said first push-up member and said second spring clip portion of said second push-up member respectively and at least rotating either said first push-up member or said second push-up member about an engaging position between said first assembly engaging portion and said second assembly engaging portion against an urging force of said spring member pulling said first spring clip portion and said second spring clip portion.

11. The image generating apparatus according to claim 10, wherein said recess portion includes a first engaging section, said projecting portion includes a second engaging section for rotatably engaging with said recess portion, and said first engaging section of said projecting portion and said second engaging section of said recess portion are so formed as to extend in a first direction perpendicular to a direction of said urging force of said spring member.

12. The image generating apparatus according to claim 10, wherein a length of said second engaging section of said projecting portion along said first direction perpendicular to said direction of said urging force is larger than a protruding length of said projecting portion along said direction of said urging force.

13. The image generating apparatus according to claim 10, wherein said recess portion and said projecting portion are rectangularly formed.

14. The image generating apparatus according to claim 10, wherein said second engaging portion includes a receiving hole having a size capable of receiving said first engaging portion, and said second engaging portion is so formed that said first engaging portion and said second engaging portion are rotatably engaged with each other by engaging said first assembly engaging portion and said second assembly engaging portion with each other and rotating at least said first push-up member or said second push-up member about said engaging position between said first assembly engaging portion and said second assembly engaging portion against said urging force of said spring member pulling said first spring clip portion and said second spring clip portion, thereby inserting said first engaging portion into said receiving hole of said second engaging portion.

15. The image generating apparatus according to claim 10, wherein said first assembly engaging portion is provided between said first spring clip portion and said first engaging portion, and said second assembly engaging portion is provided closer to said first push-up member than said second engaging portion.

* * * * *